US008510862B1

(12) United States Patent
Contant et al.

(10) Patent No.: US 8,510,862 B1
(45) Date of Patent: Aug. 20, 2013

(54) LEG PAD FOR A HOCKEY PLAYER

(75) Inventors: Mathieu Contant, Verdun (CA); Jean-François Laperrière, Prévost (CA); Marco Beauregard, Morin-Heights (CA); Marie-Claude Généreux, Sainte-Thérèse (CA)

(73) Assignee: Bauer Hockey, Inc., Exeter, NH (US)

( * ) Notice: Subject to any disclaimer, the term of this patent is extended or adjusted under 35 U.S.C. 154(b) by 0 days.

(21) Appl. No.: 13/475,395

(22) Filed: May 18, 2012

(51) Int. Cl.
*A41D 13/06* (2006.01)

(52) U.S. Cl.
USPC ..... 2/22

(58) Field of Classification Search
USPC ..... 2/22, 24, 16, 23, 242, 267, 911; 602/16, 602/23, 26; 128/882
See application file for complete search history.

(56) References Cited

U.S. PATENT DOCUMENTS

| | | | | | |
|---|---|---|---|---|---|
| 1,624,129 | A * | 4/1927 | Barrett | 2/22 |
| 2,982,968 | A * | 5/1961 | Groot | 2/22 |
| 4,674,157 | A | 6/1987 | Litz | |
| 4,692,946 | A * | 9/1987 | Jurga | 2/22 |
| 4,698,845 | A | 10/1987 | Cosby | |
| 5,732,411 | A * | 3/1998 | Coleman et al. | 2/22 |
| 5,742,938 | A | 4/1998 | Winningham et al. | |
| 5,898,939 | A * | 5/1999 | Schramm | 2/22 |
| 6,178,556 | B1 * | 1/2001 | Foreman et al. | 2/22 |
| 6,560,781 | B1 * | 5/2003 | Keene et al. | 2/22 |
| 6,654,961 | B2 | 12/2003 | Beland | |
| 6,687,912 | B2 | 2/2004 | Collins et al. | |
| 6,912,729 | B2 * | 7/2005 | Nishimoto | 2/22 |
| 6,964,062 | B1 * | 11/2005 | Chen | 2/22 |
| 7,797,760 | B2 | 9/2010 | Morrow et al. | |
| 7,797,764 | B2 | 9/2010 | Norris | |
| 7,832,017 | B2 | 11/2010 | Nascimento et al. | |
| 7,845,017 | B2 | 12/2010 | Godshaw et al. | |
| 2004/0083527 | A1 * | 5/2004 | Budda | 2/22 |
| 2008/0120756 | A1 * | 5/2008 | Shepherd | 2/22 |
| 2010/0229276 | A1 * | 9/2010 | Bevier | 2/22 |

* cited by examiner

*Primary Examiner* — Amy Vanatta

(57) ABSTRACT

The invention relates to a leg pad for a hockey player. The leg pad extends along a longitudinal axis and comprises an upper portion, a bottom portion and a band. The upper portion has a knee cap for covering a knee joint of the player. The bottom portion has an upper shell for covering a substantial part of a shin of the hockey player and a lower shell for at least partially covering the shin and ankle of the hockey player. The band extends along part of a periphery of the upper shell and part of a periphery of the lower shell. The band interconnects the upper shell and the lower shell to one another wherein the lower shell is movable relative to the upper shell between a first position and a second position in response to flexion of the ankle.

32 Claims, 6 Drawing Sheets

LEG PAD FOR A HOCKEY PLAYER

FIELD OF THE INVENTION

The present invention relates to a leg pad for a hockey player. The leg pad provides adequate protection and flexion in the ankle region of the player.

BACKGROUND OF THE INVENTION

In recent years, sporting equipment has been evolving to accommodate the need for increased protection. Due to the competitive and aggressive nature of some sports, it has been an objective of sports equipment makers to improve protective gear all the while permitting flexibility and comfort for the player. However, in many cases, an increase in protection can lead to a decrease in maneuverability due to the rigidity of the protective material.

Conventional hockey leg pads generally comprise two protective portions. One portion is located in the knee region and the other portion generally protects the shin region. However, depending on the length of the shin protecting region, the ankle may not be adequately protected. In cases where the shin protecting region substantially overlaps the ankle, the player may exhibit discomfort while moving and skating due to the obstructive nature of the rigid protective material at the bottom part of the leg pad. More specifically, the player may experience a limited range of motion in occurrences that require flexing the player's ankle. On the other hand, should the player need a greater range of motion in the ankle region, the player may use a shorter leg pad, but a part of the ankle or forefoot may then be exposed.

There is therefore a need for a hockey leg pad providing adequate protection in the ankle region and having an upper shell and a lower shell is movable relative to the upper shell. According to one feature, a band interconnects the lower shell to the upper shell such that the lower shell is movable between a first position and a second position in response to flexion of the ankle. The bottom part of the upper shell and the top part of the lower shell may overlap when the lower shell is in the first position.

SUMMARY OF THE INVENTION

According to one aspect of the present invention, there is provided a leg pad for a hockey player. The leg pad extends along a longitudinal axis and comprises an upper portion, a bottom portion and a band. The upper portion has a knee cap for covering a knee joint of the player. The bottom portion has an upper shell for covering a substantial part of a shin of the hockey player and a lower shell for at least partially covering the shin and ankle of the hockey player. The band extends along part of a periphery of the upper shell and part of a periphery of the lower shell. The band interconnects the upper shell and the lower shell to one another wherein the lower shell is movable relative to the upper shell between a first position and a second position in response to flexion of the ankle.

According to another aspect of the present invention, there is provided a leg pad for a hockey player. The leg pad extends along a longitudinal axis and comprises an upper portion, a bottom portion and a band. The upper portion comprises a knee cap for covering a knee joint of the player. The bottom portion has an upper shell for covering a substantial part of a shin of the hockey player and a lower shell for at least partially covering the shin and ankle of the hockey player. The band extends along part of a periphery of the upper shell and part of a periphery of the lower shell. The band interconnects the lower shell to the upper shell such that the lower shell is movable between a first position and a second position in response to flexion of the ankle. The upper shell and the lower shell overlap when the lower shell is in the first position.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of embodiments of the present invention is provided hereinbelow with reference to the following drawings, in which.

Figure 1:
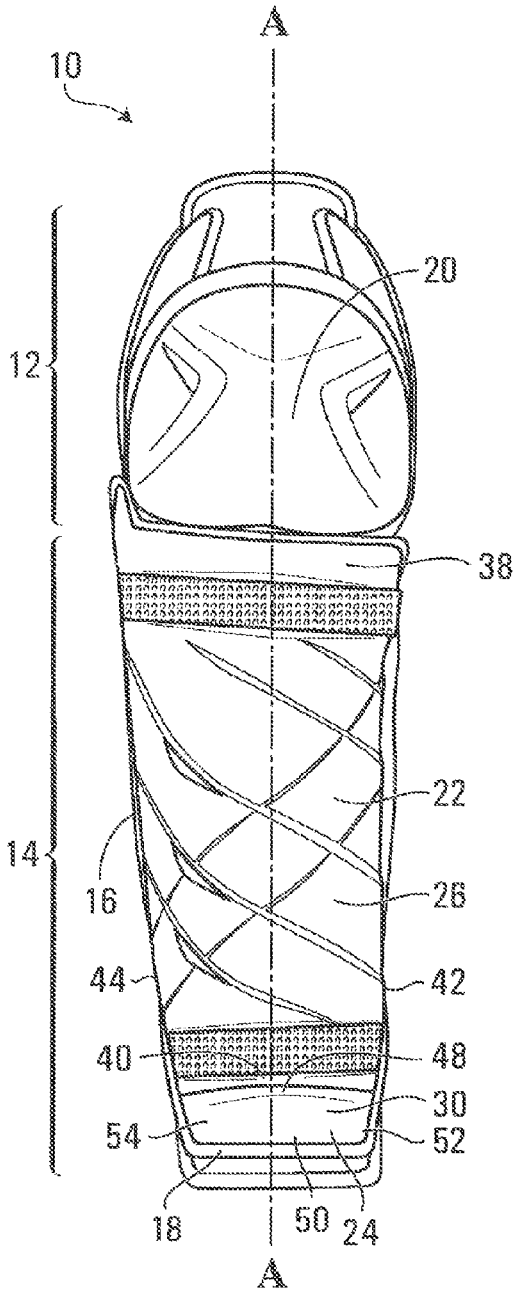
FIG. 1 is a front view of a leg pad in accordance with an embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
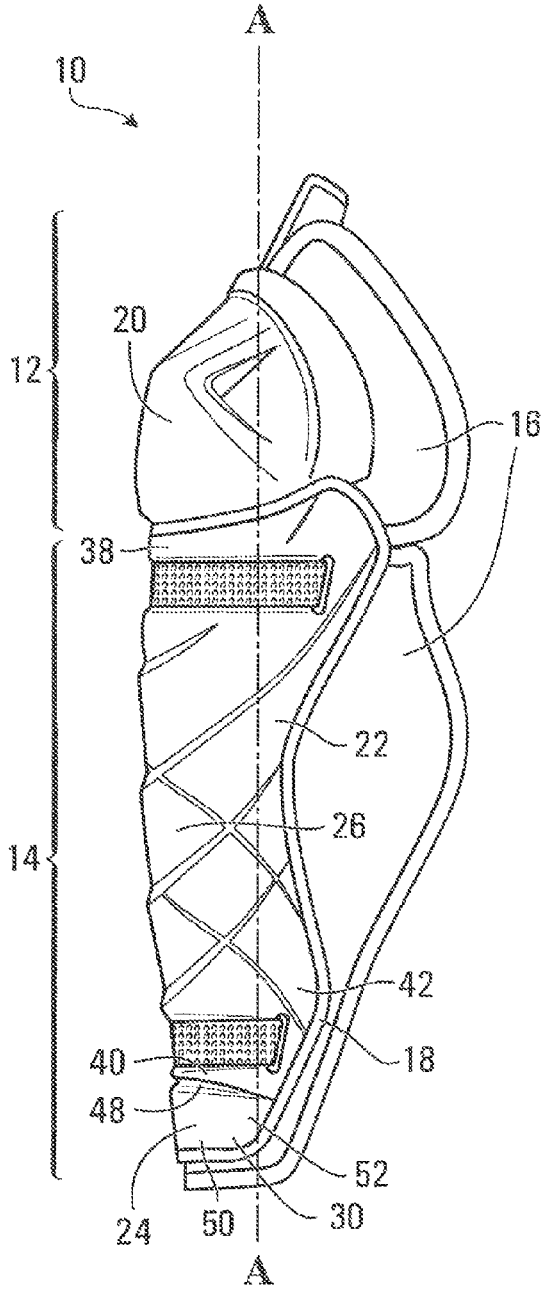
FIG. 2 is a side view of the leg pad of FIG. 1.

With reference to FIGS. 1 and 2, there is shown a non-limiting example of a leg pad 10 in accordance with the invention. The leg pad 10 extends along a longitudinal axis A-A and comprises an upper portion 12, a bottom portion 14, a liner 16 and a band 18. The upper portion 12 comprises a knee cap 20 for protecting the knee of a player's leg. The bottom portion 14 comprises an upper shell 22 and a lower shell 24.

Figure 3A:
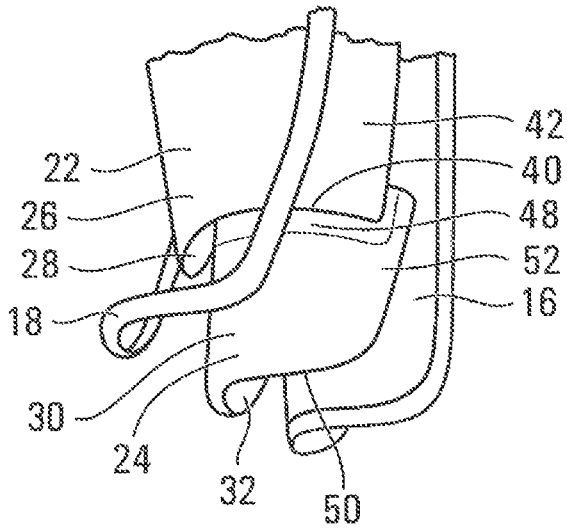
FIG. 3A is an enlarged exploded perspective view of the bottom portion of the leg pad.
Figure 3B:
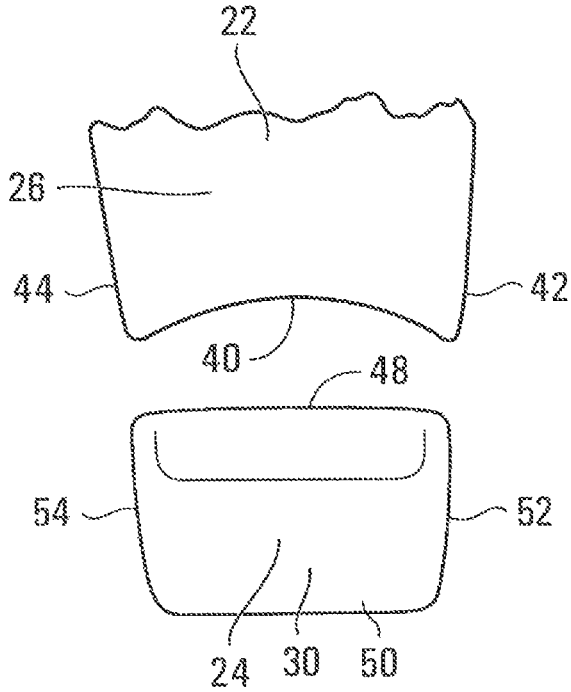
FIG. 3B is an enlarged exploded front view of the bottom portion of the leg pad showing only the upper shell and the lower shell.

With reference to FIGS. 3A and 3B, the upper shell 22 and the lower shell 24 are shown in more detail. The upper shell 22 has an outer side 26 and an inner side 28, the outer side 26 being opposed to the inner side 28. The lower shell 24 has an outer side 30 and an inner side 32, the outer side 30 being opposed to the inner side 32.

The upper shell 22 also comprises a top edge 38, a bottom edge 40, a left edge 42 and a right edge 44 and the lower shell 24 also comprises a top edge 48, a bottom edge 50, a left edge 52 and a right edge 54. The upper shell 22 substantially protects the shin portion of a player's leg and the lower shell 24 substantially protects the ankle portion of a player's leg. More specifically, the lower shell 24 covers the lower front part of the player's ankle and may also cover the player's forefoot.

The upper and lower shells 22, 24 may be made of a rigid plastic material for providing adequate protection in case of impact with a stick, a puck, or collisions with another player for example. It is known in the art that hockey leg shells can be made of NYLON, polycarbonate materials, thermoplastics, thermosetting resins, polyethylene, high density polyethylene (HDPE), polypropylene or any other suitable material. In one embodiment, the upper shell 22 and the lower shell 24 may be formed of the same material. In another embodiment, the upper shell 22 and the lower shell 24 may be formed of different materials. In yet another embodiment the upper shell 22 and the lower shell 24 may each comprise a combination of at least two materials. The upper and lower shells 22, 24 may be manufactured or shaped via any method that is known in the art. For example, the upper and lower shells 22, 24 may be molded or thermoformed.

The liner 16 is mounted under the upper and lower shells 22, 24 and is adapted to be disposed between the upper and lower shells 22, 24 and the player's shin and ankle. The liner 16 may be made of any suitable material or composition or materials that provide the degree of cushioning and protection that is desired. The liner 16 may be made of a soft material such as foam, polyethylene, low density polyethylene (LDPE) or any other suitable material. The liner 16 may also be made of foam material covered by layers of woven synthetic yarn, such as closed cell foam of ethylene vinyl acetate covered by a mesh outer layer of a woven synthetic material such as polyester. Such materials would conform itself to the anatomy of the player and may dampen any blows that might occur on the upper shell 22 or lower shell 24. The liner 16 may also be slightly oversized with respect to the upper and lower shells 22, 24 such that the liner 16 may further envelop and protect areas of the player that are not substantially covered by the upper and lower shells 22, 24. It is understood that the liner 16 may be omitted if the upper and lower shells 22, 24 are made, for example, of a rigid outer layer and a soft inner layer affixed to the rigid outer layer.

The band 18 extends along part of a periphery of the upper shell 22 and part of a periphery of the lower shell 24, the band 18 interconnecting the upper shell 22 and the lower shell 24 to one another. In one embodiment, the band 18 extends along the entire periphery of the assembled upper shell 22 and lower shell 24. In another embodiment, the band 18 may extend along a portion of the peripheries of the upper shell 22 and lower shell 24.

The band 18 may be a strip of fabric such as a woven stretchable fabric. The band 18 may also be a braiding.

Figure 4A:
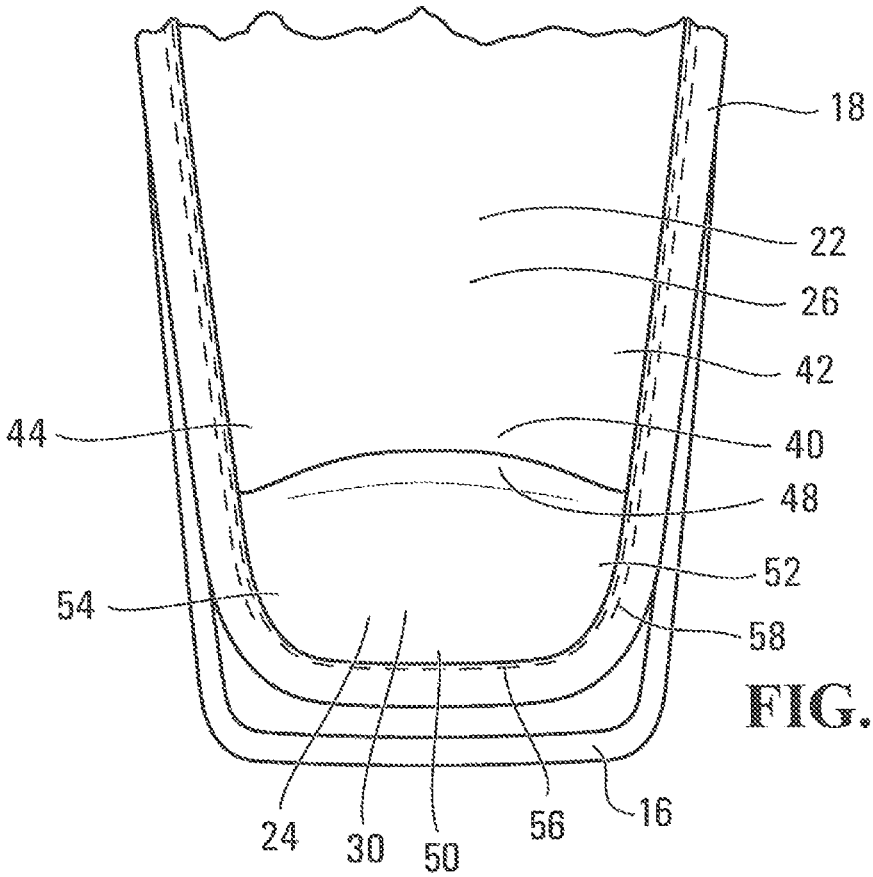
FIG. 4A is an enlarged front view of the bottom portion of the leg pad showing the upper shell, the lower shell, the liner, the band and the stitching lines.
Figure 4B:
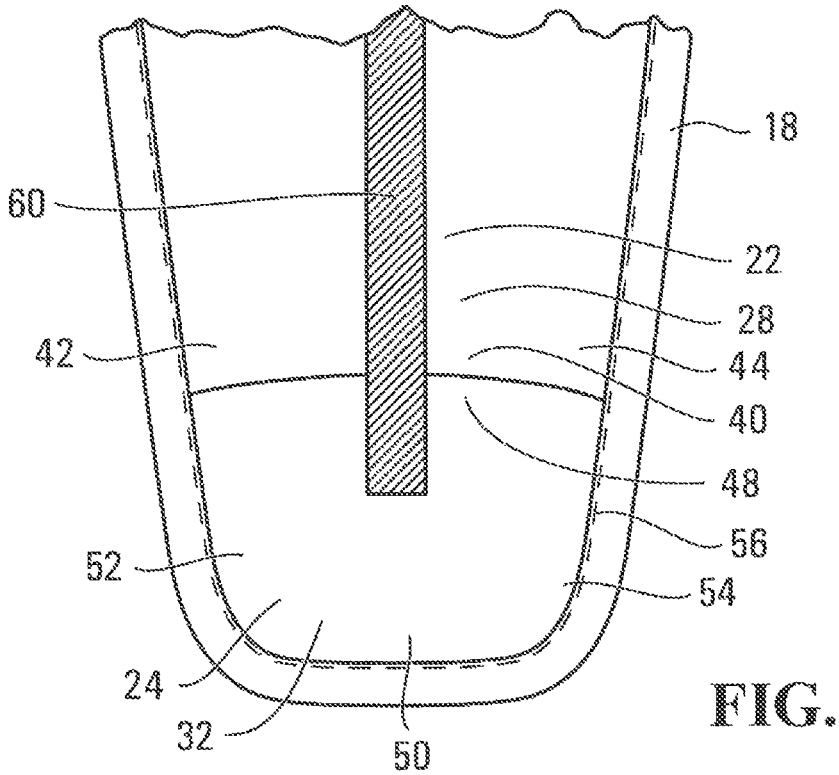
FIG. 4B is an enlarged rear view of the bottom portion of the leg pad showing the upper shell, the lower shell, the strap, the band and the stitching line.
Figure 5A:
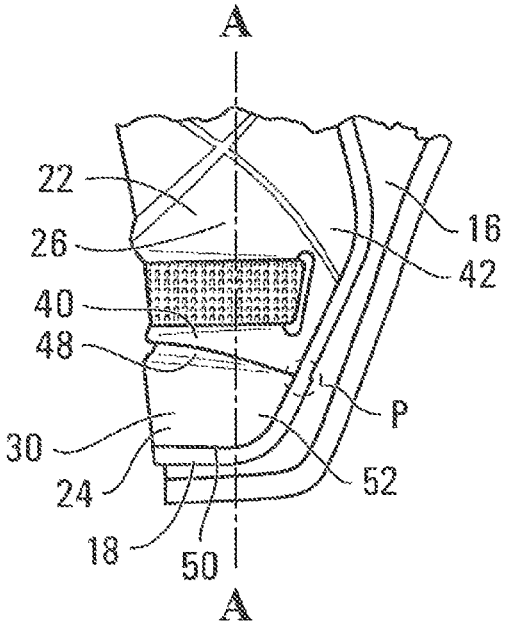
FIG. 5A is an enlarged side view of the bottom portion of the leg pad showing the lower shell in the first position.
Figure 5B:
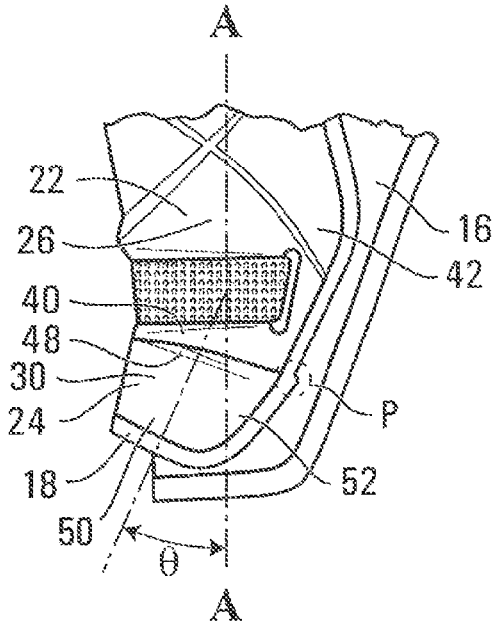
FIG. 5B is an enlarged side view of the bottom: portion of the leg pad showing the lower shell in the second position.

The band 18 may have a width large enough to cover at least partially the outer and inner sides and edges of the upper and lower shells 22, 24. As shown in FIGS. 4A and 4B, the band 18 is wide enough to cover a portion of the outer and inner sides 26, 28 and the left and right edges 42, 44 of the upper shell 22 and a portion of the outer and inner sides 30, 32 and the left, right and bottom edges 52, 54, 50 of the lower shell 24. Moreover, as best shown in FIGS. 4A, 5A and 5B, the bottom edge 40 of the upper shell 22 and the top edge 48 of the lower shell 24 are free of the band 18 such that these edges may move relative to one another.

The leg pad 10 may comprise a stitching line 56 passing through the band 18 and the upper shell 22 and passing through the band 18 and the lower shell 24 in order to affix the band 18 to the upper and lower shells 22, 24 such that the band 18 interconnects the upper shell 22 and the lower shell 24 to one another.

It is however understood that the affixation of the band 18 to the upper shell 22 and the lower shell 24 is not limited to such stitching. For example, in another embodiment, the band 18 may be affixed to the upper shell 22 and the lower shell 24 via an adhesive or any other affixing means known in the art.

Furthermore, the band 18 may be attached to the peripheries of the upper shell 22 and the lower shell 24 such that the band 18 biases the lower shell 24 towards the first position. Such a bias would avoid that the lower shell 24 undesirably remain in the second position even after the player has extended his/her foot.

The leg pad 10 may also comprise a stitching line 58 passing through the band 18 and the upper shell 22 and liner 16 and passing through the band 18 and the lower shell 24 and liner 16 in order to affix the assembled upper shell 22 and lower shell 24 to the liner 16 such that the band 18 also interconnects the upper and lower shells 22, 24 to the liner 16.

Figure 6A:
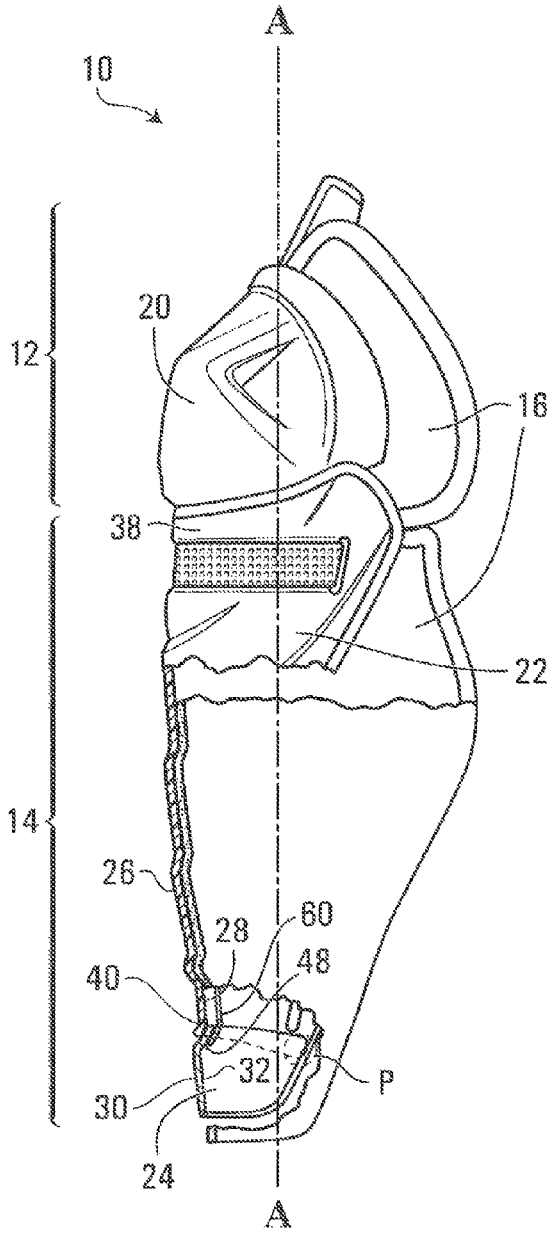
FIG. 6A is a side view of the leg pad showing a partial cross section of the lower portion of the leg pad and the lower shell in the first position.
Figure 6B:
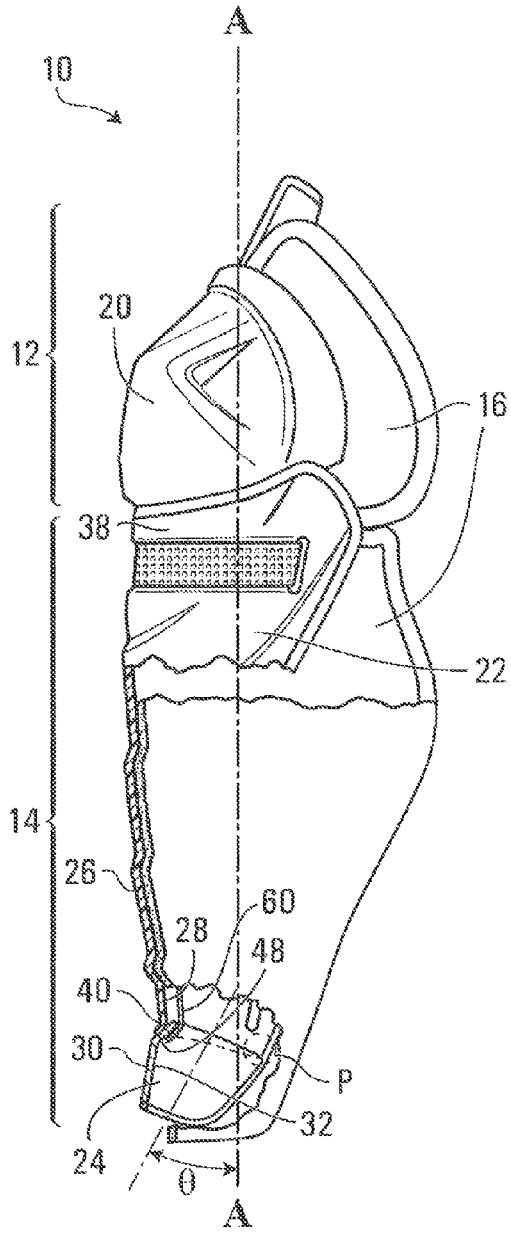
FIG. 6B is a side view of the leg pad showing a partial cross section of the lower portion of the leg pad and the lower shell in the second position.

In either case, the lower shell 24 is movable relative to the upper shell 22 in response to a flexion motion of the player's ankle. As best shown in FIGS. 5A, 5B, 6A and 6B, the movement induced by the flexion movement of the player's ankle will cause the lower shell 24 to move from a first position to a second position. As best shown in FIGS. 5A and 6A, when the lower shell 24 is in the first position, the lower shell 24 may be in an extended position where it extends generally parallel to the longitudinal axis A-A of the leg pad such that the upper and lower shells 22, 24 are generally straight or rectilinear. As best shown in FIGS. 5B and 6B, when the lower shell 24 moves from the first position to the second position in response to the flexion motion of the player's angle, the lower shell 24 then pivots about a pivot region P and defines an angle θ relative to the longitudinal axis A-A of the leg pad. Hence, in the second position, the lower shell 24 may be in a retracted or angled position where it extends along an axis that defines an angle θ relative to the longitudinal axis A-A. In one embodiment, the angle θ relative to the longitudinal axis may be up to 10°. In another embodiment, the angle θ relative to the longitudinal axis may be up to 15°. It is understood that the movement of the lower shell 24 relative to the upper shell 22 may be a combination of a pivotable movement and a slight translation movement that is allowed, for example, by the stretchability of the band 18 (see the band 18 in the pivot region P).

As shown in FIG. 6A, when the lower shell 24 is in the first position, the upper and lower shells 22, 24 are positioned relative to one another to avoid a gap therebetween. More particularly, in the first position, there is a first overlap between the bottom edge 40 of the upper shell 22 and the top edge 48 of the lower shell 24. In the first position, the first overlap, when measured along the longitudinal axis A-A, may be between 2 mm and 12 mm. In another embodiment, this first overlap may be between 5 mm and 10 mm. When the lower shell 24 is in the second position, as shown in FIG. 6B, there is a second overlap between the bottom edge 40 of the upper shell 22 and the top edge 48 of the lower shell 24, the second overlap being greater than the first overlap. In the second position, the second overlap, when measured along the longitudinal axis A-A, may be between 5 mm and 20 mm. In another embodiment, this second overlap may be between 15 mm and 20 mm. As best shown in FIGS. 5A, 5B, 6A and 6B, the bottom edge 40 of the upper shell 22 overlaps the top edge 48 of the lower shell 24 in order to avoid a gap when the lower shell 24 moves from the second position to the first position.

Figure 7:
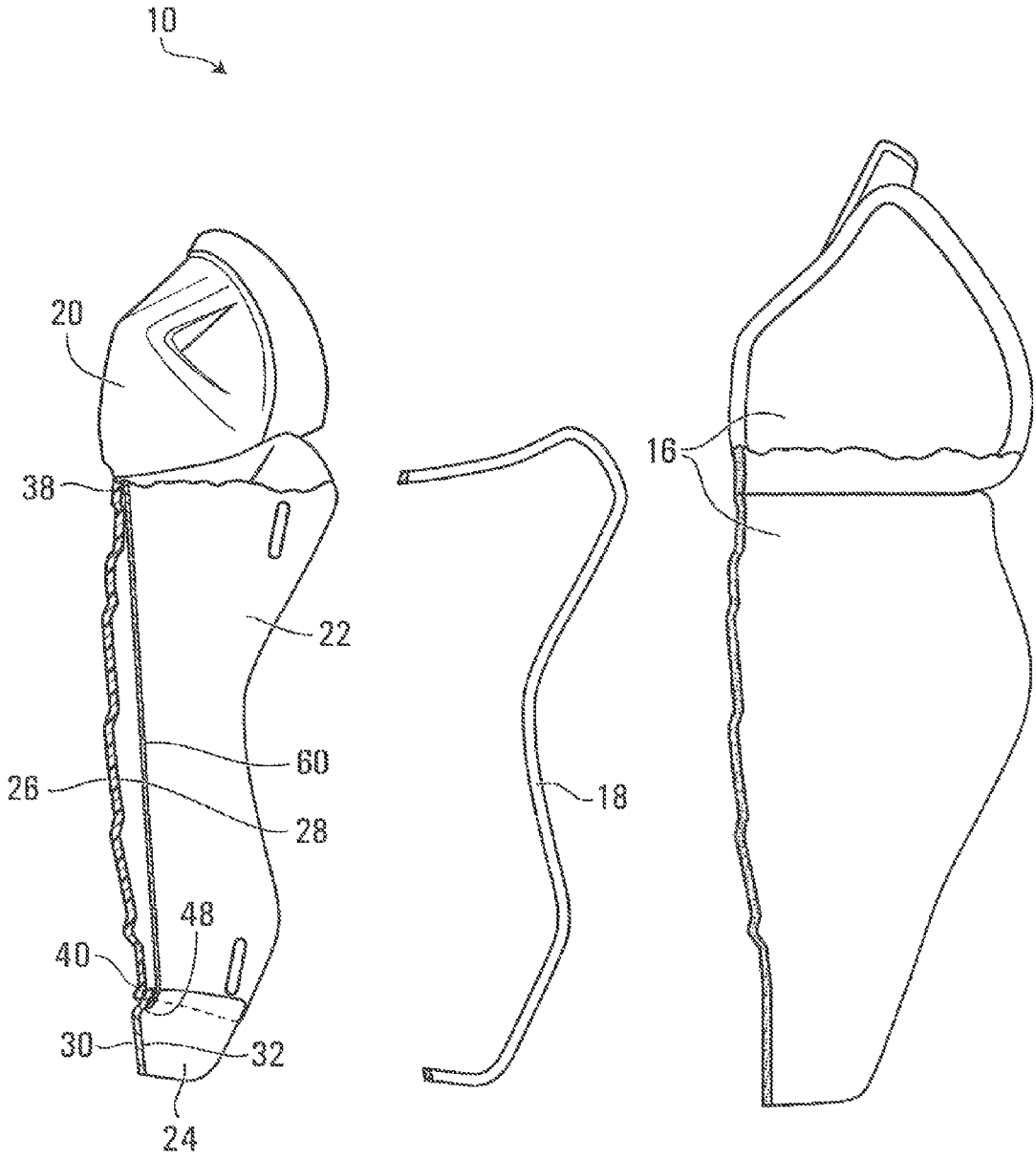
FIG. 7 is a side exploded view of the leg pad showing a cross section of the lower portion of the leg pad.

As best shown in FIGS. 4B and 7, the leg pad 10 may comprise a strap 60 which connects the upper shell 22 and the lower shell 24. The strap 60 may be connected to the inner sides 28, 32 of the upper and lower shells 22, 24. The strap 60 may restrict the top edge 48 of the lower shell 24 from moving over the bottom edge 40 of the upper shell 22. The strap 60 may also ensure that the lower shell 24 remains generally parallel to the longitudinal axis A-A of the leg pad 10 when pressure is applied on the lower shell for moving/pivoting the lower shell 24 inwardly (for example, in a direction towards a player's ankle).

Although various embodiments have been illustrated, this was for the purpose of describing, but not limiting, the invention. Various changes, modifications and enhancement may be made to the embodiments and the scope of the claims should not be limited by the embodiments, but should be given the broadest interpretation consistent with the description as a whole.

The invention claimed is:

1. A leg pad for a hockey player, said leg pad extending along a longitudinal axis and comprising:

(a) an upper portion having a knee cap for covering a knee joint of the player;

(b) a bottom portion having an upper shell for covering a substantial part of a shin of the hockey player and a lower shell for at least partially covering the shin and ankle of the hockey player; and (c) a band extending along part of a periphery of said upper shell and part of a periphery of said lower shell, said band interconnecting said upper shell and said lower shell to one another wherein said lower shell is movable relative to said upper shell between a first position and a second position in response to flexion of the ankle.

2. A leg pad as defined in claim 1, wherein said upper shell has an outer side opposed to an inner side and a peripheral edge between said outer and inner sides, said lower shell has an outer side opposed to an inner side and a peripheral edge between said outer and inner sides, and wherein said band overlies said inner side, outer side and peripheral edge of said upper shell and overlies said inner side, outer side and peripheral edge of said lower shell.

3. A leg pad as defined in claim 2, wherein said peripheral edge of said upper shell has a bottom edge and left and right side edges and said peripheral edge of said lower shell has top and bottom edges and left and right side edges, wherein said band covers said left and right side edges of said upper and lower shells and wherein said bottom edge of said upper shell and said top edge of said lower shell are free of said band.

4. A leg pad as defined in claim 3, wherein said band further covers said bottom edge of said lower shell.

5. A leg pad as defined in claim 1, wherein said band is a strip of woven stretchable fabric.

6. A leg pad as defined in claim 3, wherein said band is a braiding.

7. A leg pad as defined in claim 6, wherein said braiding has a width large enough for covering said left and right side edges of said upper and lower shells and said bottom edge of said lower shell.

8. A leg pad as defined in claim 7, wherein a stitch line affixes said braiding to at least one of said inner and outer sides of either of said upper and lower shells.

9. A leg pad as defined in claim 1, wherein said lower shell is generally parallel to said longitudinal axis of said leg pad when said lower shell is in said first position and wherein said lower shell defines an angle relative to said longitudinal axis of said leg pad when said lower shell is in said second position.

10. A leg pad as defined in claim 9, wherein said angle relative to said longitudinal axis of said leg pad is up to 15°.

11. A leg pad as defined in claim 1, wherein said band biases said lower shell towards said first position.

12. A leg pad as defined in claim 2, wherein said leg pad also comprises a strap connecting said inner side of said upper shell to said inner side of said lower shell.

13. A leg pad as defined in claim 12, wherein said upper shell has a bottom edge and said lower shell has a top edge and wherein said strap restricts said top edge of said lower shell from moving over said bottom edge of said upper shell.

14. A leg pad as defined in claim 13, wherein, in use, said strap ensures that said lower shell remains generally parallel to said longitudinal axis of said leg pad when pressure is applied to said lower shell for moving said lower shell inwardly.

15. A leg pad as defined in claim 1, further comprising a liner mounted under said upper and lower shells, said liner being adapted to be disposed between said upper and lower shells and the player's shin and ankle.

16. A leg pad for a hockey player, said leg pad extending along a longitudinal axis and comprising:

(a) an upper portion comprising a knee cap for covering a knee joint of the player;

(b) a bottom portion having an upper shell for covering a substantial part of a shin of the hockey player and a lower shell for at least partially covering the shin and ankle of the hockey player; and (c) a band extending along part of a periphery of said upper shell and part of a periphery of said lower shell, said band interconnecting said lower shell to said upper shell such that said lower shell is movable between a first position and a second position in response to flexion of the ankle, said upper shell and said lower shell overlapping when said lower shell is in said first position.

17. A leg pad as defined in claim 16, wherein said upper shell has an outer side opposed to an inner side and a peripheral edge between said outer and inner sides, said lower shell has an outer side opposed to an inner side and a peripheral edge between said outer and inner sides, and wherein said band overlies said inner side, outer side and peripheral edge of said upper shell and overlies said inner side, outer side and peripheral edge of said lower shell.

18. A leg pad as defined in claim 17, wherein said peripheral edge of said upper shell has a bottom edge and left and right side edges and said peripheral edge of said lower shell has top and bottom edges and left and right side edges, wherein said band covers said left and right side edges of said upper and lower shells, wherein said bottom edge of said upper shell and said top edge of said lower shell are free of said band and wherein said bottom edge of said upper shell overlaps said top edge of said lower shell when said lower shell moves from said second position to said first position.

19. A leg pad as defined in claim 16, wherein said upper shell and said lower shell overlap when said lower shell is in said second position, an overlap of said upper shell and said lower shell when said lower shell is in said second position being greater than an overlap of said upper shell and said lower shell when said lower shell is in said first position.

20. A leg pad as defined in claim 19, wherein said first overlap, when measured along said longitudinal axis, is between 2 mm and 12 mm.

21. A leg pad as defined in claim 19, wherein said second overlap, when measured along said longitudinal axis, is between 5 mm and 20 mm.

22. A leg pad as defined in claim 18, wherein said band further covers said bottom edge of said lower shell.

23. A leg pad as defined in claim 16, wherein said band is a strip of woven stretchable fabric.

24. A leg pad as defined in claim 18, wherein said band is a braiding.

25. A leg pad as defined in claim 24, wherein said braiding has a width large enough for covering said left and right side edges of said upper and lower shells and said bottom edge of said lower shell.

26. A leg pad as defined in claim 16, wherein said lower shell is generally parallel to said longitudinal axis of said leg pad when said lower shell is in said first position and wherein said lower shell defines an angle relative to said longitudinal axis of said leg pad when said lower shell is in said second position.

27. A leg pad as defined in claim 26, wherein said angle relative to said longitudinal axis of said leg pad is up to 15°.

28. A leg pad as defined in claim 16, wherein said band biases said lower shell towards said first position.

29. A leg pad as defined in claim 17, wherein said leg pad also comprises a strap connecting said inner side of said upper shell to said inner side of said lower shell.

30. A leg pad as defined in claim 29, wherein said upper shell has a bottom edge and said lower shell has a top edge and wherein said strap restricts said top edge of said lower shell from moving over said bottom edge of said upper shell.

31. A leg pad as defined in claim 30, wherein, in use, said strap ensures that said lower shell remains generally parallel to said longitudinal axis of said leg pad when pressure is applied to said lower shell for moving said lower shell inwardly.

32. A leg pad as defined in claim 16, further comprising a liner mounted under said upper and lower shells, said liner being adapted to be disposed between said upper and lower shells and the player's shin and ankle.

* * * * *